US005416987A

United States Patent [19]

Bemis et al.

[11] Patent Number: 5,416,987

[45] Date of Patent: May 23, 1995

[54] SPEED CLOSURE FOR FOOTWEAR

[75] Inventors: Jon L. Bemis, Santa Monica; Kristin N. Cotsidas, Manhattan Beach, both of Calif.

[73] Assignee: L.A. Gear, Inc., Santa Monica, Calif.

[21] Appl. No.: 153,001

[22] Filed: Nov. 12, 1993

[51] Int. Cl.[6] ..... A43B 11/00; A43B 23/26

[52] U.S. Cl. ..... 36/50.1; 36/54

[58] Field of Search ..... 36/50.1, 54; 24/712, 24/712.1, 712.2, 712.3, 712.4

[56] References Cited

U.S. PATENT DOCUMENTS

| | | |
|---|---|---|
| 2,454,335 | 11/1948 | Nichols . |
| 2,871,537 | 2/1959 | Hickerson . |
| 4,081,916 | 4/1978 | Salisbury . |
| 4,414,761 | 11/1983 | Mahood . |
| 4,553,342 | 11/1985 | Derderian . |
| 4,811,500 | 3/1989 | Maccano . |
| 4,928,405 | 5/1990 | Spademan . |
| 5,027,482 | 7/1991 | Torppey . |
| 5,042,119 | 8/1991 | Williams . |
| 5,117,567 | 6/1992 | Berger . |
| 5,177,882 | 1/1993 | Berger . |
| 5,181,331 | 1/1993 | Berger . |

*Primary Examiner*—Paul T. Sewell

*Assistant Examiner*—Ted Kavanaugh

*Attorney, Agent, or Firm*—Don C. Lawrence

[57] ABSTRACT

A speed closure (100) for footwear (10) comprises an elastic instep strap (110) having ends (111, 112) on opposite sides of the wearer's foot. The ends of the strap terminate in pulleys (114, 115) interleaved between the tongue (28) and respective ones of the flaps of the shoe for independent, sliding movement therebetween. A foldable fastening tab (120) is moveably attached to the tongue of the shoe. A tensioning line (140) having ends joined to form a continuous loop is threaded in an ordered sequence through eyelets (34) in the flaps, eyelets (127) in the tab, and the line pulleys, such that the line does not pass through any pulley more than once, and through any eyelet more than twice, and such that the line does not cross over itself. A cowl (150) is disposed over the instep of the shoe to cover portions of the instep opening of the shoe, the tongue, and the tab. The cowl has a top edge (151) and sides that lap past the flaps and attach to respective sides of the shoe. A portion (121) of the tab extends outwardly from between the tongue and the top edge of the cowl. Pulling out on the tab tightens the closure, and folding the tab down over the cowl and engaging mating fasteners (125, 126) therebetween locks it in the tightened condition.

15 Claims, 2 Drawing Sheets

Fig. 1.
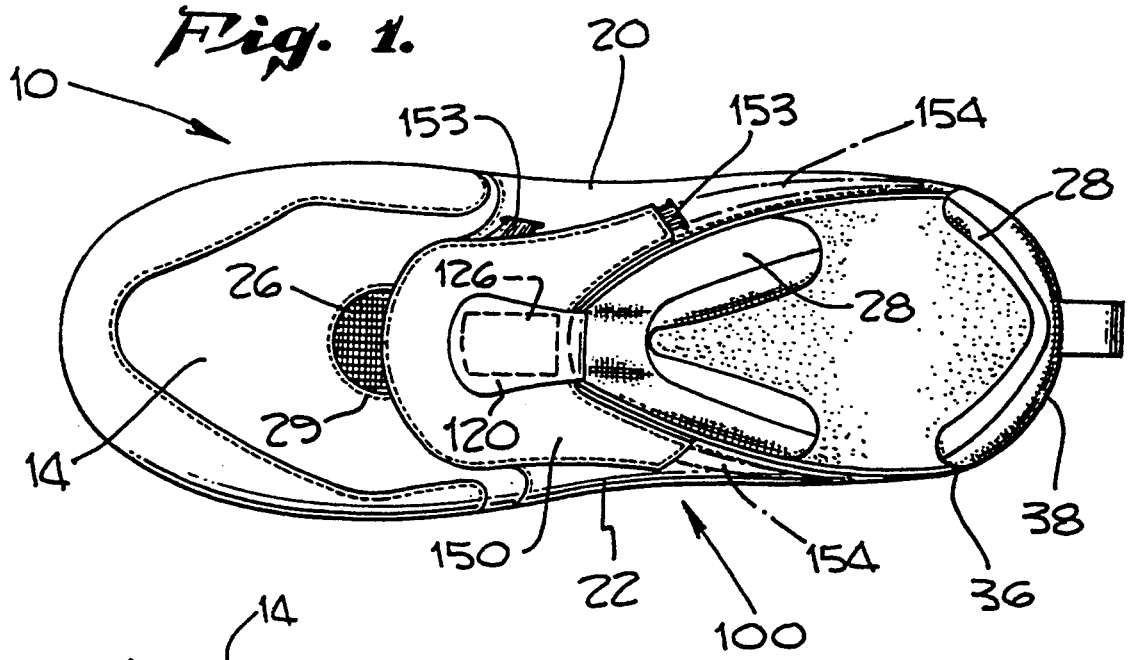
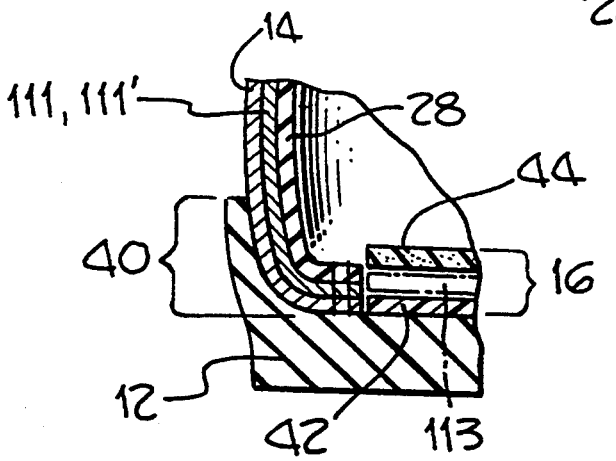
Fig. 5.
Fig. 2.
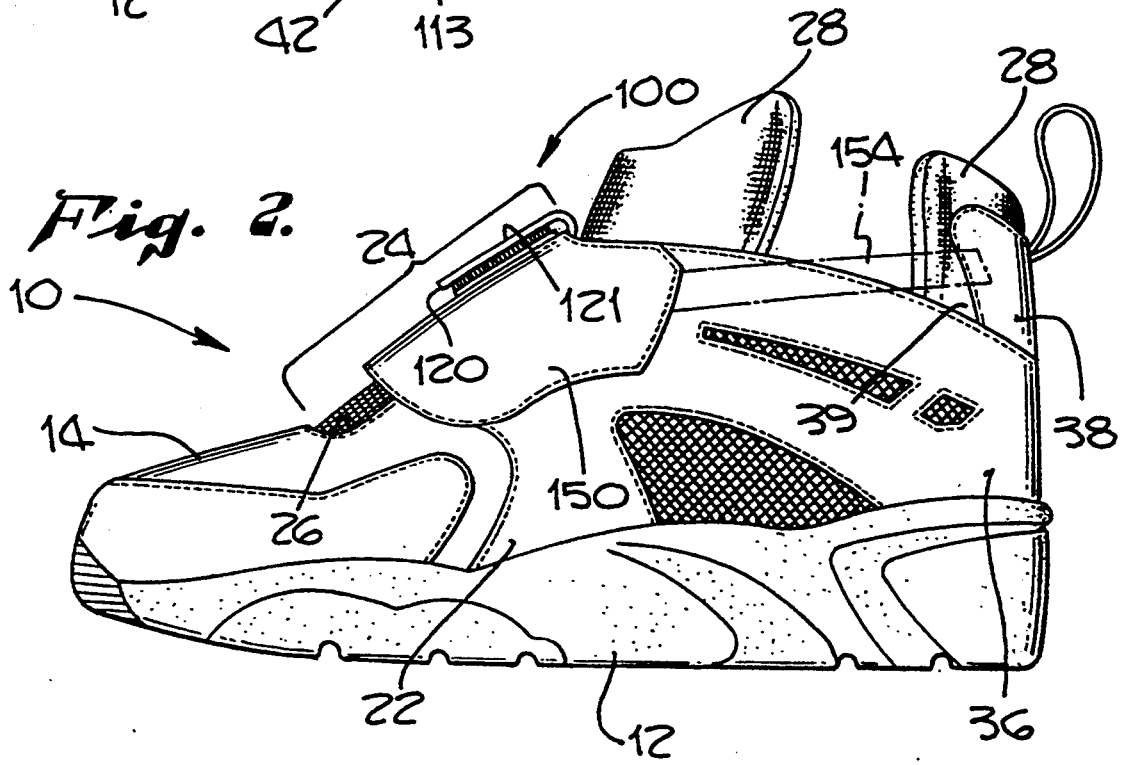

SPEED CLOSURE FOR FOOTWEAR

BACKGROUND OF THE INVENTION

1. Field of the Invention

This invention pertains to footwear in general, and in particular, to a closure system for footwear that can be quickly operated by the wearer using one hand to tighten the footwear on the wearer's foot, or conversely, loosen it for removal.

2. Description of the Related Art

A conventional blucher-type shoe or boot typically incorporates a closure comprising a flexible upper having an enlongated slot or opening over the wearer's instep and a pair of separate, opposing flaps along either side of the opening. The flaps contain a plurality of lace eyelets in opposed relation to one another across the opening, and typically overlay a tongue, attached to the upper at the vamp, that directly contacts the instep of the wearer's foot. A single lace is continuously threaded in criss-cross fashion between diagonal eyelets, from the bottom of the instep to the top, with the two lace ends extending loosely outward from a pair of eyelets at or near the top of the instep. The closure is tightened over the wearer's foot by pulling both lace ends forcefully and simultaneously further outwardly from the eyelets, thereby causing the flaps to be drawn toward one another across the wearer's instep, and is secured in the tightened condition by tying a bow knot in the lace ends.

This type of footwear closure is very old, and although inexpensive to make and simple to operate, has a number of problems associated with it. One of these is that it can be relatively slow to effect, as described below, and requires the use of both hands to tighten the closure, a disadvantage for persons having the use of only one hand. Another is that the bow knot used to secure the closure can be difficult for young children to tie, and is often unreliable after tying, leading to a loosened condition of the shoe, and requiring that the closure be re-tightened and re-knotted after only a short wear period. Finally, the laces, tongue and instep opening of the closure are all open and exposed to the entry of din, which can adversely affect its operation.

Another problem relates to the degree of frictional engagement between the lace and the eyelets. If high, the shoe is hard to lace up, and if low, exacerbates the tendency of the closure to loosen should the knot begin to loosen. And, if this value is inconsistent from eyelet to eyelet, it can result in a non-uniform tension on the foot at different points along the instep. This latter problem can be overcome to a certain extent by a "hitching-up" proceedure in which both sides of the lace are grasped simultaneously between the thumb and forefinger of both hands at various points along the instep and, proceeding from bottom of the instep to the top, pulling out on both sides of the lace simultaneously to tighten the closure at localized regions along the instep, the slack in the lace generated thereby being passed up to the next point of localized tension adjustment, and so on, until the lace ends at the top of the closure are reached. This procedure is slow, tedious, and necessitates the use of both hands.

Over the years, a number of closure systems have been devised in an attempt to overcome some or all of these problems. One of these, described in U.S. Pat. No. 4,553,342 to T. Derderian, et al., intersperses eyelet pairs having a relatively high degree of frictional engagement of the lace between pairs of "free-running" eyelets, i.e., eyelets having a low frictional engagement with the lace, to afford the wearer means for achieving an adjustable instep width and tension that can be individually adjusted in various regions along the instep. Although this system offers some advantages over a conventional closure in terms of instep width and tension adjustment, it still incorporates the unreliable bow-knot feature, requires the use of both hands, and is open to the entry of dirt.

Another such closure system is described in U.S. Pat. No. 2,454,335 to H. Nichols. In some of Nichols' closure embodiments, the tongue of the shoe is not attached to the upper, but rather, is free to slide up and down along the midline of the upper relative to the wearer's instep. Two ends of a lace are joined to form a continuous loop, and the lace is threaded through all of the eyelets in the flap and, in one embodiment, through a plurality of eyelets in the tongue, such that the portions of the lace extending between the flap and the tongue eyelets are in a straight, horizontal configuration when the flaps are at their maximum distance apart. When the tongue is pulled downwardly along the instep toward the toe of the shoe, the portions of the lace lying between the flap eyelets and the tongue eyelets are pulled from the straight, horizontal configuration, to an inverted-Vee configuration, thereby pulling the flaps together to tighten the upper. A snap fastener on the tongue bottom mates with a fastener on the vamp of the upper to hold the closure in the tightened condition. While this system addresses some of the problems described above, such as the need for two-handed operation, it is inapplicable to footwear having a tongue fixed to the upper, such as athletic footwear having a so-called "sock-tongue" construction, as well as to other types of footwear having a relatively high lace-loading over the instep, because of its necessity for a moving tongue, and the attendant high degree of sliding friction between it and the wearer's foot, the laces themselves, and the underside of the flaps.

Another closure system is described in a trio of patents to C. Berger, U.S. Pat. Nos. 5,117,567; 5,117,882; and, 5,181,331. In Berger's system, a rigid, plastic "instep shield" is disposed over the instep opening and attached to either the tongue, or the upper at the vamp. Each flap of the shoe has one of two plastic "instep flaps" attached to it in opposed relation to a respective side of the shield such that instep flaps form a vee-shaped opening on either side of the shield. The instep flaps may be attached to the sole by straps that extends down the sides of the shoe. A single cable, which may be a "Bowden" cable, has its two ends joined together to form a continuous loop that is threaded through a series of low-friction grooves or guide blocks molded in the shield and the instep flaps such that, by pulling the upper end of the loop, the two instep flaps are pulled toward the instep shield with a uniform force, tightening the closure. The top of the cable loop is wound onto a cable spool, or reel, at the top end of the instep shield such that, when the spool is turned, the loop of cable is wound onto it, thereby effecting tightening of the closure. An optional instep shield cover can be provided over the whole instep region to protect the closure and to keep out dirt. While this form of closure addresses most of the problems of the conventional lace closure described above, it also appears to be somewhat expensive to fabricate and complicated to assemble.

Other examples of footwear speed closures may be found in U.S. Pat. No. 5,027,482 to S. Torrpey, U.S. Pat. No. 4,414,761 to D. Mahood, and U.S. Pat. No. 4,081,916 to T. Salisbury.

The subject of this invention, a speed closure for footwear, overcomes the problems of conventional lace closures described above, yet avoids the disadvantages of the above-described prior art closures. It is quick, reliable, can be operated with one hand, provides a uniform tension over the instep of the wearer's foot, yet accomodates some foot width variations, has means for protecting the closure against din, and is relatively inexpensive to make and easy to assemble to the footwear.

SUMMARY OF THE INVENTION

The speed closure of the invention comprises at least one elastic instep strap attached inside of the upper such that the ends of the strap extend upwardly from the arch region of the footbed and along opposite sides of the wearer's foot. Each strap end terminates in a line pulley that is interleaved between the tongue and a respective one of the medial and lateral flaps and is disposed adjacent to at least one eyelet in each flap and in opposed relation across the instep opening such that they each can slide between the tongue and a respective flap in a direction towards and away from the instep opening.

An elongated fastening tab having at least two eyelets in it is disposed over the tongue in the instep opening, and is attached to the tongue such that the tab is moveable longitudinally within the instep opening relative to the tongue. The tab has first and second portions and means for hinging them together such that one portion can be folded over the other.

A smooth, flexible, relatively inelastic tensioning line has two ends joined together to form a continuous loop having medial and lateral portions. The line is threaded sequentially through respective, adjacent ones of the tab eyelets, the flap eyelets, the line pulleys, then back out the flap eyelets, and back through the tab eyelets in repetitive fashion such that the line does not pass through any pulley more than once, and through any flap or tab eyelet more than twice, and such that the medial and lateral portions of the line do not cross each other at any point in the loop.

A flexible instep cowl is disposed over the instep of the upper to cover at least a portion of the instep opening, the tongue, and the fastening tab. The cowl has top and bottom edges, and medial and lateral sides that lap past respective ones of the medial and lateral flaps and attach to respective sides of the upper or the sole. The first portion of the fastening tab extends outwardly from between the tongue and the top edge of the cowl such that the first portion can be grasped with the fingers of one hand.

In operation, the fastening tab is pulled outwardly from between the cowl and the tongue in a longitudinal direction, causing segments of the line loop extending into the upper through the flap eyelets to shorten. This, in turn, causes the flaps, the pulleys, and their associated instep strap ends to be drawn toward each other across the instep, thereby tightening the closure on the wearer's foot. The first portion of the fastening tab can then be folded down over the upper surface of the cowl, and the first and second halves of a complementary-mating fastener pair disposed on respective ones of the underside of the tab and the upper surface of the cowl engaged with one another to secure the closure in the tightened condition.

A better understanding of the invention, its operation, and its many attendant advantages may be obtained by a consideration of the following detailed description of its preferred embodiments, particularly if such description is considered in conjunction with the accompanying drawings. A brief description of these drawings now follows.

BRIEF DESCRIPTION OF THE DRAWINGS

FIG. 1 is top plan view of an athletic shoe incorporating the speed closure of the present invention;

FIG. 2 is a lateral side elevational view of the shoe seen in FIG. 1;

DETAILED DESCRIPTION OF THE PREFERRED EMBODIMENTS

Figure 3:
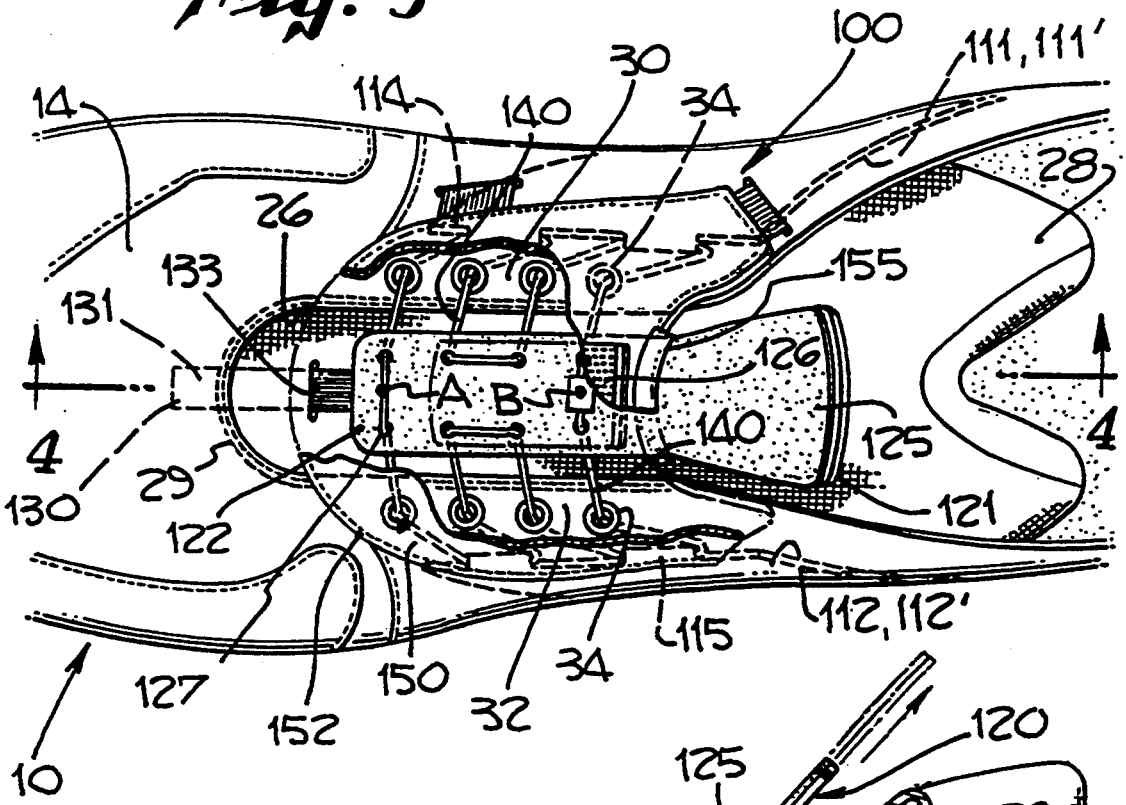
FIG. 3 is a partial top plan view of the shoe similar to FIG. 1, with a cowl of the closure partially broken away to reveal other details of the closure, and with a section taken along the lines 4—4.

A typical modem athletic shoe 10 of a type to which the present invention is particularly suited is shown in plan view in FIG. 1 and in a medial side elevational view in FIG. 2. The shoe 10 comprises a sole 12 and an upper 14.

The sole 12, which is typically molded from a foamed and/or solid rubber or synthetic elastomer, such as polyurethane ("PU") and ethylene vinyl acetate ("EVA"), has an outer periphery, medial and lateral sides corresponding to respective ones of the medial and lateral sides of a wearer's foot, an upper surface comprising a footbed 16 within the shoe for the wearer's foot, and may further include midsole and outsole portions, depending on the particular construction involved. For purposes of description, the footbed 16 of the sole may be divided longitudinally into a forefoot region, a heel region, and an arch region 18 between the forefoot and heel regions, each region underlying a corresponding region on the underside of the wearer's foot.

The upper 14 is typically fabricated from a flexible leather, vinyl, or polyurethane sheet material, or increasingly today, composites of these. The upper 14 has a medial side 20 and a lateral side 22, each corresponding to a respective side of the wearer's foot. The upper includes an instep 24, corresponding to the instep of the wearer's foot, and an elongated opening 26 in the instep. A tongue 28 is disposed within the instep opening and is attached to the upper, typically by sewing a lower end of it to the upper at the vamp 29 of the shoe. As may be seen in FIG. 3, a medial flap 30 and a lateral flap 32 are defined along respective ones of the medial and lateral side margins of the instep opening 26 in overlying relation to the tongue 28. The flaps have at least one pair of eyelets 34 in opposed relation across the instep opening 26. The upper also includes heel portion 36, including a heel counter 38 that extends upwardly from the sole behind the achilles tendon of the wearer's foot, and optionally, may extend above at the sides of the upper to define a pair of opposed notches, or openings, 39 therein between the instep and the counter to clear the malleoli of the wearer's ankle, and to make the counter 38 more flexible with respect to the remainder of the upper when the wearer is donning the shoe.

The upper 14 also comprises a bottom margin that is generally coextensive with the outer periphery of the sole 12. The bottom margin of the upper is attached, typically by adhesive means, to the upper surface of the sole about its periphery to define an attachment seam 40 between the upper and the sole. In the exemplary embodiment illustrated, which incorporates so-called "slip-last" construction, the upper also includes a sheet, or "lasting sock," 42 (see FIG. 5) that is sewn around the entire bottom margin of the upper prior to the attachement of the upper to the sole, such that the bottom surface of the lasting sock 42 is adhered to the upper surface of the sole 12 and comprises a portion of the footbed 16 of the shoe.

In the exemplary embodiment illustrated in the figures, the shoe 10 also incorporates a so-called "sock-tongue," i.e., the tongue 28 is fabricated of a soft, resilient, spongy material, such as polyurethane foam, and is overlaid with a resilient, elastic cloth material having a decorative, colored pattern, such as that sold under the name, Lycra. In addition to the portion underlying the instep opening 26 and sewn to the vamp 29, as described above, the sock-tongue 28 also includes a medial side portion, a lateral side portion, and a heel portion, all sewn together to define an open-toed, open-bottomed sock that is disposed inside of the upper, between the upper and the wearer's foot, to surround and protect corresponding portions of the foot. The sock-tongue is sewn to the upper at the vamp 29, and along a common lower margin extending through the arch and heel regions of the footbed 16 adjacent to the attachment seam 40.

The footbed 16 of the shoe 10 may also comprise an insole 44 disposed over the upper surface of the lasting sock 42. The insole is typically die cut or molded from a foamed elastomer to provide more cusioning in the footbed for the wearer's foot, and may be loosely fitted on top of the footbed or adhesively attached to it.

Skilled practitioners will recognize that the exemplary athletic shoe 10, as described up to this point, is fairly conventional in terms of its components and construction. Indeed, if a conventional shoe lace (not illustrated) were threaded in criss-cross fashion between diagonal eyelets in the flaps, from the bottom of its instep to the top, the shoe could be closed in the conventional manner by pulling on both lace ends simultaneously to tighten it on the wearer's foot, then tying a bow knot in ends of the lace. It is therefore desirable now to describe an improved form of closure for this shoe, which closure is the subject of this invention.

The speed closure of the instant invention is generally represented in the figures by the numeral 100. The closure comprises, in its constituent parts, at least one elastic instep strap 110, an elongated fastening tab 120, attachment means 130 for attaching the fastening tab to the tongue, a smooth, relatively inelastic tensioning line 140, and an instep cowl 150 over the instep for protecting the closure and preventing the entry of dirt.

The elastic instep strap 110 is disposed inside of the upper 14, between the upper and the side parts of the sock-tongue 28, on respective sides of the instep 24. It has a medial end 111, a lateral end 112, and a central portion 113 between the two ends. In the exemplary embodiment illustrated, the central portion 113 of the strap extends across the arch region 18 of the footbed 16, from the medial side 20 to the lateral side 22 of the upper 14, and is attached to the upper between the upper and the sock-tongue on both sides of the sole 12, adjacent to the attachment seam 40 (FIGS. 4 and 5).

In FIG. 5, the central portion 113 of the instep strap 110 is shown dotted to illustrate that, in an alternative embodiment, the instep strap can comprise a pair of instep straps 111', 112' disposed inside of the upper 14, between the upper and the side parts of the sock-tongue 28, on respective sides the instep 24. In this embodiment, the central portion 113 of the single instep strap 110 is eliminated, and the alternative instep straps 111', 112' are each attached by a lower end to a respective side of the upper in the arch region 18 of the footbed 16, adjacent to the attachment seam 40, as best seen in FIG. 5.

Figure 4:
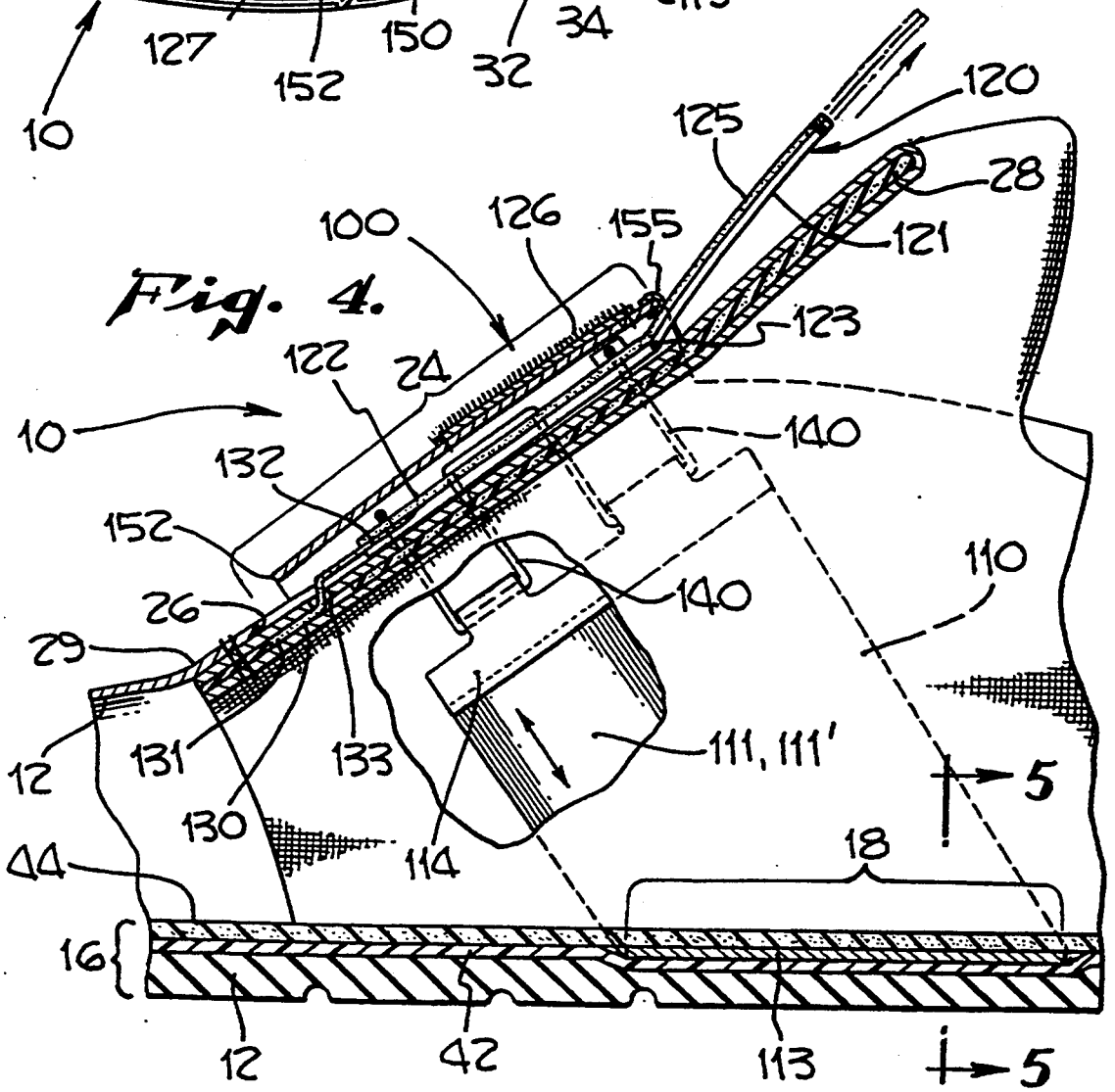
FIG. 4 is a sectional side elevational view into the shoe, as revealed by the section taken along the lines 4—4 in FIG. 3, and wherein another section is taken along lines 5—5; and, FIG. 5 is a partial sectional view of the medial side of the sole and upper of the shoe looking aft, as revealed by the section taken along the lines 5—5 in FIG. 4.

The medial and lateral ends 111, 112 of the instep strap are each terminated in at least one line guide, or pulley, 114, 115 (FIGS. 4 and 5). The pulleys have apertures through them to accept and guide the tensioning line 140 through the pulleys in the manner illustrated. The apertures of the pulleys have certain characteristics in common with the eyelets in the flaps 30, 32 and in the fastening tab 120, namely, they are all relatively smooth, larger in diameter than the diameter of the tensioning line 140, and have a low coefficient of friction relative to it, such that the line can run freely through any one of them.

In the embodiment illustrated, the line pulleys 114, 115 are die cut from a sheet of thin metal or flexible plastic, then folded over and riveted or stitched to respective ones of the ends 111 or 111' and 112 or 112' of the instep strap(s) 110. It is highly preferrable that the pulleys attach to the instep strap ends across their entire width, such that a tensile load imparted to the strap ends by the pulleys will be uniformly distributed over the entire width of the strap ends, as opposed to being applied at discrete points or regions within the width, so that the tension imparted by the strap ends to the sides of the wearer's foot will also be uniformly distributed along the foot.

The medial and lateral ends 111, 112 of the instep strap 110, along with respective ones of their line pulleys 114, 115, extend upwardly and forwardly from the sole 12 on either side of the wearer's foot such that the strap ends and their respective pulleys are interleaved between the tongue 28 and a respective one of the medial and lateral flaps 30, 32 of the shoe, to slide between the tongue and the respective flap in a direction toward and away from the instep opening, as shown by the arrows in FIG. 4, with the pulleys being positioned in opposed relation across the instep opening 26, and generally adjacent to, and outboard of, the flap eyelets 34. By this arrangement, the pulleys and strap ends are free to move co-circumferentially with, but independently of, the flaps, about the wearer's instep. By thus "de-coupling" the ends of the strap, which is relatively elastic, from the flaps of the upper, which are relatively inelastic, the closure 100 is thereby better able to accomodate variations in the width of the wearer's instep, and to apply a more uniform closing force over it, than other closures that lack these features.

The elongated fastening tab 120 is loosely disposed over the tongue 28 in the instep opening 26. The tab has a first portion 121, a second portion 122, and means 123 between the two portions for hinging them together horizontally such that the first portion can be folded over the second portion. In the exemplary embodiment illustrated, the fastening tab is fabricated from a relatively flexible, inelastic material, e.g., leather, such that the means 123 for hinging the two portions of the tab together comprise the resulting natural hinge formed in the material of the tab by folding it over on itself.

The first portion 121 of the fastening tab 120 has an upper surface, with a half 125 of a complementary-mating fastener pair 125, 126 mounted thereon (FIG. 3). In the exemplary embodiment illustrated, the fastener pair half 125 consists of a patch of "loop" material from a hook-and-loop fastener pair, such as that sold under the name, Velcro. However, skilled practitioners will recognize that other complementary-mating fastener pairs can also serve in this particular fastening application, such as snap fastener pairs, hook-and-eye fastener pairs, etc.

In FIG. 3, the second portion 122 of the fastening tab 120 has at least one pair of side-by-side eyelets 127 in it, the eyelets being disposed generally adjacent to, and slightly inboard of, the flap eyelets 34. In general, the tab eyelets 127 have the same characteristics with respect to tensioning line 140 as described above in connection with the apertures in the pulleys 114, 115 and the flap eyelets 34.

It is desirable that the fastening tab 120 be attached to the tongue, yet be moveable longitudinally within the instep opening 26 between the upper surface of the tongue 28 and the lower surface of the cowl 150, for reasons described below. To achieve this end, attachment means, comprising a simple elastic band 130, are provided. The band 130 has two ends, 131, 132. One of these ends, 131, passes through a slot 133 in the tongue and is attached to the tongue behind the slot by stitching. The other end 132 of the elastic band 130 is attached to an end of the second portion 122 of the fastening tab 120, such that the tab can move resiliently back and forth within the instep opening in the direction indicated by the arrows in FIG. 3.

In the preferred embodiment of the closure 100, the tensioning line 140 comprises a strand of Dacron or Nylon monofilament. This provides a smooth, strong, flexible, and relatively inelastic tensioning line having low frictional properties. The line 140 has two ends that are joined together, such as with the crimping connector 141 shown, to form a continuous loop having medial and lateral portions. The two loop portions are conterminous with each other at two points A, B defined within the loop to be generally centered on the instep 24 between adjacent pairs of tab eyelets 127. In the embodiment illustrated, the point A is centered between the lowermost pair of tab eyelets 127, and the point B is centered between the uppermost pair of tab eyelets, which latter location corresponds with that of the line crimp connector 141.

Respective ones of the medial and lateral portions of the loop extend medially and laterally away from the points A and B, and the line 140 is threaded sequentially through respective, adjacent ones of the tab eyelets 127, the flap eyelets 34, the line pulleys 114, 115, then back through the flap eyelets, the tab eyelets, and so on, in repetitive fashion along the length of the instep 24 and symmetrically about it, such that the line does not pass through any pulley more than once, and does not pass through any flap or tab eyelet more than twice, and such that the medial and lateral portions of the line do not cross each other between the points A and B.

Skilled practitioners will recognize that the simplest case of the closure 100 described thus far would comprise a single pair of flap eyelets 34, a single pair of fastening tab eyelets 127, and a single pair of pulleys 114, 115, which, in this case, could comprise nothing more than a pair of "pulley eyelets" disposed at the apex of two triangular-shaped medial and lateral instep strap ends. In this simplest case, the tensioning line 140 would pass through each pulley eyelet once, and through each flap and fastening tab eyelet twice, and the points A and B in the line would be disposed immediately adjacent to one another at the middle of the fastening tab, between the two tab eyelets.

In a more general, preferred embodiment, the closure 100 comprises at least two pair of flap eyelets 34, at least two pair of fastening tab eyelets, and a single pair of pulleys 114, 115 of the type illustrated. In this preferred embodiment, the tensioning line 140 passes through each pulley, each flap eyelet, and each fastening tab eyelet only once, thereby minimizing the stress on any one pulley and eyelet, and any frictional wear occasioned by the line rubbing against itself. In this embodiment the point A is disposed between the lowermost pair of tab eyelets, and the point B is disposed between the uppermost pair of tab eyelets and spaced apart from point A by the spacing of the eyelet pairs.

The last component of the novel closure 100 to be described comprises a flexible instep cowl 150 disposed over the instep 24 of the shoe 10 to protect the closure and keep dirt out of the instep opening. The cowl, which is shaped to wrap around and conform to the shape of the instep, gives the shoe 10 a smooth, streamlined look, and is disposed over the instep to cover at least a portion of the instep opening 26, a portion of the tongue 28, and the second portion 122 of the fastening tab 120. It is fashioned from an attractive, flexible material, such as leather, and has a top edge 151, a bottom edge 152, medial and lateral sides that overlap respective ones of the medial and lateral flaps 30, 32, and an upper surface having the second half 126 of the complementary-mating fastener pair 125, 126 mounted thereon.

The medial and lateral sides of the cowl 150 are each attached to a respective side of the upper 14, such as by sewing, and, in the embodiment illustrated, at least one side of the cowl is attached to its respective side of the upper by means of at least one elastic band 153, such that the cowl is resiliently moveable over the instep with respect to the upper. In a preferred alternative embodiment, the elastic bands 153 can extend down the outside of the upper to the arch region 18 of the sole and attach to the shoe between the sole and the upper at the attachment seam 40. In yet another preferred alternative embodiment, shown in phantomed lines in FIGS. 1 and 2, the sides of the cowl can also attach to the heel counter 38 by means of elastic bands 154 that span the ankle opening 39 and resiliently hold the counter against the rear of the wearer's foot.

The first portion 121 of the fastening tab 120 extends outwardly from between the tongue 28 and the top edge 151 of the cowl such that the first portion can be easily grasped by the wearer's fingers. Operation of the closure 100 is simple, one-handed, and quick: When the fastening tab is pulled further outwardly from between the tongue and the top edge of the cowl in a longitudinal direction, segments of the line loop extending into the upper 14 through the flap eyelets 34 are shortened, thereby causing the flaps 30, 32, the pulleys 114, 115, and their associated instep strap ends 111, 112, all to be drawn toward each other across the wearer's instep, thereby tightening the closure on the wearer's foot. The first portion 121 of the fastening tab can then be folded down over the upper surface of the cowl, and the first and second halves of the complementary-mating fastener pair 125, 126 engaged with one another, thereby releasibly locking the closure in the tightened condition.

Skilled practitioners will recognize that certain modifications in the materials, components and operation of the novel closure 100 are possible, depending on the particular problem at hand. For example, the top edge 151 of the cowl 150 can be reinforced with a tab pulley 155, comprising a strong, smooth, rounded surface, or roller, extending across the top edge of the cowl to provide a smooth sliding surface for the tab and to prevent the top edge of the cowl from breaking down due to the tensile forces exerted on it by the tab.

Also, if desirable, it is possible to reverse the mounting of the fastening tab 120 by reversing its orientation within the instep opening 26, such that the first portion 121 of the tab extends out from between the tongue 28 and the bottom edge 152 of the cowl 150. In this embodiment, the first portion of the tab is pulled downwardly with respect to the intep to tighten the enclosure, then folded up over the cowl to lock it in the tightened condition.

Indeed, many other modifications to the instant closure are possible, without changing its essential nature and its many advantages. Accordingly, the scope of the invention should not be limited by that of the particular exemplary embodiments described and illustrated herein, but rather, by the scope of the claims that are appended hereafter.

What is claimed is:

1. An improved speed closure for footwear of the type having a sole and a flexible upper, the sole having an outer periphery, medial and lateral sides, and an upper surface comprising a footbed, the footbed having a heel region, a forefoot region, and an arch region between the heel and forefoot regions, the upper having medial and lateral sides, an instep, an elongated opening in the instep, a fixed tongue at the instep opening, medial and lateral flaps defined along respective ones of the medial and lateral side margins of the instep opening in overlying relation to the tongue, and a bottom margin generally coextensive with the outer periphery of the sole, the bottom margin of the upper being attached to the upper surface of the sole about its periphery to define an attachment seam, the flaps having at least one pair of eyelets in opposed relation across the instep opening, the improved closure, in combination with the above elements, comprising:

at least one elastic instep strap disposed inside of the upper, the strap having a medial end, a lateral end, and a central portion between the two ends, the central portion of the strap being attached to at least one of the upper and the sole, each strap end being terminated in at least one line pulley, the medial and lateral ends of the strap, along with respective ones of their line pulleys, being disposed in opposed relation across the instep opening and interleaved between the tongue and a respective one of the medial and lateral flaps to slide between the tongue and the respective flap in a direction toward and away from the instep opening, the pulleys being positioned generally adjacent to, and slightly outboard of, the flap eyelets;

an elongated fastening tab disposed over the tongue in the instep opening, the tab having a first portion, a second portion, and means between the two portions for hinging them together horizontally such that one of the portions can be folded over the other portion, the first portion having an upper surface and a first half of a complementary-mating fastener pair mounted thereon, the second portion having at least one pair of side-by-side eyelets in it, the eyelets being disposed generally adjacent to, and slightly inboard of, the flap eyelets;

attachment means for attaching the tab to the tongue such that the tab is moveable longitudinally within the instep opening relative to the tongue;

a tensioning line having two ends joined together to form a continuous loop, the loop having a medial portion and a lateral portion, the two portions being conterminous with each other at first and second points within the loop, the first and second points each being generally centered on the instep between the tab eyelets, respective ones of the medial and lateral portions of the loop extending medially and laterally away from the first and second points and being threaded sequentially through respective, adjacent ones of the tab eyelets, the flap eyelets, the line pulleys, the flap eyelets, and the tab eyelets, in repetitive fashion along the instep and symmetrically about it, such that the line does not pass through any pulley more than once, and does not pass through any flap or tab eyelet more than twice, and such that the medial and lateral portions of the line do not cross each other between the first and second points; and, an instep cowl shaped to wrap around and conform to the shape of the instep, the cowl being disposed over the instep to cover at least a portion of the instep opening, a portion of the tongue, and the second portion of the fastening tab, the cowl having top and bottom edges, medial and lateral sides that overlap respective ones of the medial and lateral flaps, and an upper surface having a second half of the complementary-mating fastener pair mounted thereon, the medial and lateral sides of the cowl each being attached to a respective side of at least one of the upper and the sole, the first portion of the fastening tab extending outwardly from between the tongue and at least one of the top and bottom edges of the cowl such that the first portion can be grasped, whereby, when the tab is pulled further outwardly from between the tongue and the edge of the cowl in a longitudinal direction, segments of the line loop extending into the upper through the flap eyelets are shortened, thereby causing the flaps, the pulleys, and their associated instep strap ends to be drawn toward each other across the instep and tightening the closure, and whereupon the fastening tab can then be folded back over the upper surface of the cowl, and the first and second halves of the complementary-mating fastener pair engaged with one another, thereby releasibly locking the closure in the tightened condition.

2. The closure of claim 1, wherein the central portion of the instep strap extends across the arch region of the footbed from the medial side to the lateral side of the upper and is attached to a respective side of at least one of the upper and the sole adjacent to the attachment seam.

3. The closure of claim 1, wherein the at least one instep strap further comprises a pair of straps disposed inside of the upper on respective sides thereof, each strap having an upper end terminated in at least one line pulley and a lower end attached to a respective side of at least one of the upper and the sole in the arch region of the footbed adjacent to the attachment seam.

4. The closure of claim 1, wherein the attachment means for attaching the tab to the tongue comprises an elastic band having two ends, one end being attached to the tongue, and the other end being attached to the second portion of the tab.

5. The closure of claim 1, wherein the tensioning line does not pass through any flap eyelet more than once.

6. The closure of claim 5, wherein the tensioning line does not pass through any tab eyelet more than once.

7. The closure of claim 1, wherein the tensioning line does not pass through any tab eyelet more than once.

8. The closure of claim 1, wherein at least one of the medial and the lateral sides of the cowl is attached to a respective side of at least one of the sole and the upper by means of at least one elastic strap disposed outside of the upper, the strap having a first end attached to a respective side of the cowl, and a second end attached to a respective side of at least one of the sole and the upper, whereby the cowl is resiliently moveable with respect to the instep.

9. The closure of claim 8, wherein the second end of the elastic strap is attached to a respective side of at least one of the sole and the upper in the arch region of the footbed adjacent to the attachment seam.

10. The closure of claim 8, wherein the upper has a heel counter extending above at least one of the medial and the lateral sides of the upper to define at least one ankle opening therein between the heel counter and the instep, and wherein the second side of the elastic strap is attached to the heel counter across the opening.

11. The closure of claim 1, wherein the first portion of the fastening tab extends outwardly from between the tongue and the top edge of the cowl, such that the first portion can be folded down over the cowl, with respective ones of their upper surfaces in facing relation.

12. The closure of claim 11, wherein the top edge of the cowl is reinforced with a tab pulley.

13. The closure of claim 1, wherein the first portion of the fastening tab extends outwardly from between the tongue and the bottom edge of the cowl, such that the first portion can be folded up over the cowl, with respective ones of their upper surfaces in facing relation.

14. The closure of claim 13, wherein the bottom edge of the cowl is reinforced with a tab pulley.

15. The closure of claim 1, wherein the complementary-mating fastener pair comprises a hook-and-loop fastener.

* * * * *